United States Patent [19]

Wenzel

[11] 3,948,166

[45] Apr. 6, 1976

[54] DEVICE FOR SEPARATING THE ROLLERS OF A CALENDER

[75] Inventor: Reinhard Wenzel, Tonisvorst, Germany

[73] Assignee: Kleinewefers Industrie Companie GmbH, Krefeld, Germany

[22] Filed: Apr. 2, 1975

[21] Appl. No.: 564,461

[30] Foreign Application Priority Data

Apr. 2, 1974 Germany ..... 2415836

[52] U.S. Cl. ..... 100/163 R; 100/168

[51] Int. Cl.[2] ..... B30B 3/04

[58] Field of Search ..... 100/161–170, 100/47; 72/232, 234

[56] References Cited

UNITED STATES PATENTS

| | | | |
|---|---|---|---|
| 619,107 | 2/1899 | Whitlock | 100/168 X |
| 1,575,539 | 3/1926 | Butterworth, Jr. | 100/162 R |
| 2,300,994 | 11/1942 | Thiele et al. | 100/163 A |
| 3,016,819 | 1/1962 | Kupka | 100/163 R |
| 3,369,483 | 2/1968 | Muller | 100/170 X |

FOREIGN PATENTS OR APPLICATIONS

| | | | |
|---|---|---|---|
| 1,815,240 | 6/1971 | Germany | 100/168 |

*Primary Examiner*—Peter Feldman
*Attorney, Agent, or Firm*—Walter Becker

[57] ABSTRACT

A device for separating the rollers of a calender with a suspended spindle held at its upper end on the calender frame or the uppermost roller bearing on each calender side with supporting members which are adjustable in the longitudinal direction of the spindle and which when lifting the rollers from each other abut from below against supporting parts of the roller bearings and are adapted to be secured against rotation. The suspended spindle is divided into screw elements which respectively are associated with each intermediate roller and which have their end sections provided with threaded sections oriented in opposite directions. These screw elements are adjustable independently of each other. The supporting members provided between the threaded sections oriented in opposite directions are adjustable toward and away from the supporting parts of the roller bearings.

7 Claims, 7 Drawing Figures cyl.-piston unit 1
17
8
14
15
24
23
s
2
9
25
18
43
16
42
s
10
3
45
30
s
19
x
4
11
20
4'
x
16
s
45
12
5
21
30
s
16
6
13
45
30
s
22
7

1
9
8
23
2
45a
s
10
30a
18
3
45b
2s
11
30b
19
x
4
3s
45c
x
5
30c
20
45d
4s
21
2x
6
30d
45e
5s
22
2x
7
30e 45
23
s
18
2s
19
3s
20
4s
30
5s
22

DEVICE FOR SEPARATING THE ROLLERS OF A CALENDER

The present invention relates to a device for separating the rollers of a calender with a suspended spindle on each calender side with supporting members which are adjustable in the longitudinal direction of the spindle and which when lifting the rollers rest from below against the supporting members of the roller bearings, and which supporting members are adapted to be secured against rotation. The said suspended spindle has its upper end held on the calender framework or the uppermost roller bearing.

A device for lifting superimposed rollers, especially of a calender, from each other by means of a suspended spindle on each bearing side has become known. This known device is provided with selectively controllable supporting members which rest from below against the supporting parts of the roller bearings during the lifting operation, while the spindle is rotatable over its entire length by at least the height of the intermediate roller. This selective control makes it possible selectively to vary the lifting distance between the individual rollers. If with this heretofore known device one of the intermediate rollers is exchanged, it is necessary to re-adjust the lifting gap of all rollers which are located below the roller to be exchanged.

When exchanging the uppermost intermediate roller of a 12-roller calender, twenty supporting members in the form of nuts have to be adjusted. If the calender on each calender side has an inner and an outer spindle, even twice the number of nuts is to be adjusted.

Furthermore, a calender has become known in which, for purposes of lifting the rollers of each other, each threaded nut is adjustable as a supporting member on a threaded rod with steep and non-self-locking thread while the threaded nut is between an abutment of the roller bearing and a second abutment of said bearing adjustable by the height of the gap and is adpated to be secured by a locking device against rotation in one direction of rotation.

According to a further heretofore known device, between two superimposed bearings there is arranged one threaded rod each which is adapted by means of a threaded section to be screwed into and out of a roller bearing and with its thread-free section is rotatable in the roller bearing therebelow but is axially non-displaceable.

With all heretofore known devices for separating the rollers of a calender, an adjustment of two supporting members on each threaded spindle, if not an adjustment of all supporting members below the roller to be exchanged is necessary.

It is, therefore, an object of the present invention to provide a device of the above described type with which a simplification of the adjusting possibility and of the adjusting means will be obtained when one of the intermediate rollers is exchanged between the uppermost and the lowermost roller of the calender.

These and other objects and advantages of the invention will appear more clearly from the following specification in connection with the accompanying drawings, in which.

Figure 1:
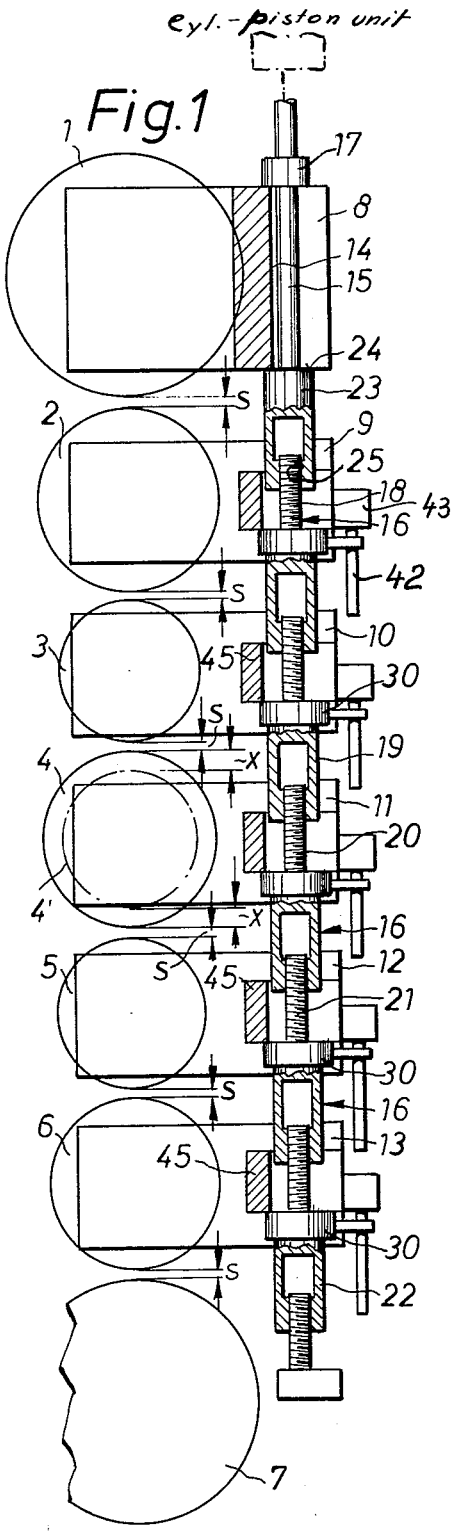
FIG. 1 is a diagrammatic side view of a calender according to the invention in which the suspended spindle is pulled and the rollers have an air space therebetween.

FIGs. 4–7*a* illustrate various embodiments of the screw elements and their drives for a calender according to the invention.

The device according to the present invention for separating the rollers of a calender with a suspended spindle having its upper end held on the calender framework or the uppermost roller bearing while the suspended spindle is located on each calender side with supporting members adjustable in the longitudinal direction of the spindle and during the roller lifting resting from below against supporting parts of the roller bearing while being secured against rotation, is characterized primarily in that the suspended spindle is divided into screw elements respectively individually associated with said intermediate rollers and provided with threads oriented in opposite directions and located at their end sections, which screw elements are adjustable independently of each other, said screw elements being arranged between said oppositely oriented threads and being adjustable in a direction toward and away from the supporting members of the roller bearings.

Screw elements with oppositely directed threads at their end sections are known. Thus, for instance, the calender set forth in U.S. Pat. No. 3,016,819 comprises between a pivotal lever on the calender frame and the calender frame itself a screw element with oppositely oriented thread while between the thread sections there is provided a fixedly arranged nut in response to the rotation of which the screw element can be taken along. By means of this screw element, however, only a higher adjusting speed of the adjustment in a direction of the pivotal supporting arm is effected so that as a result thereof the present invention was not suggested, namely to employ a screw element with oppositely oriented thread in order to provide a suspended spindle which extends over the entire region of the intermediate rollers while in response to the actuation of only one of the screw elements the roller gap above and below the associated roller is simultaneously compensated for and the roller gap of the roller located below the roller to be exchanged need not be taken into consideration. The adjustment of only one screw element on each suspended spindle for compensating the lower gap above and below the roller to be exchanged, yields the possibility again to return to a simple hand or to a semiautomatic adjustment of the supporting members or, with a full automatic adjustment of the supporting members, to adjust only one of the screw elements in order to compensate for the roller gap above and below the rollers to be exchanged.

According to a further development of the invention, the screw element may consist of a bushing with an inner thread and a threaded stud non-rotatably connected thereto and provided with oppositely directed threads. In this way, between the threaded sections of each screw element, a disengageable anti-rotation safety means may be associated with the element. With the above described screw element as well as with the screw elements of other embodiments according to the invention, each screw element is provided with a device for turning the screw element. This device may consist in a worm or spur gear drive, or the supporting member may have extension, bores, or the like by means of which the supporting element can be turned manually by means of a tool.

When the suspension spindle has a great length, the screw element may be subdivided and both element parts may be interconnected by a coupling which permits a slight curving of the suspension spindle.

The means for preventing rotation may comprise a pin which extends in spaced relationship to said spindle axis, said pin being arranged on the roller bearing or the supporting member therefor.

According to still another embodiment of the invention, the screw element may consist of a threaded spindle with two threads oriented in opposite directions and may furthermore comprise a sleeve adapted to be secured against rotation and may be provided with two inner threads oriented in opposite directions.

Referring now to the drawings in detail, the device according to the present invention has a suspension spindle which by means of a cylinder piston unit may be pulled upwardly and may be suspended on the bearing 8 of the uppermost roller 1. The suspension spindle is adapted together with said bearing 8 to be adjusted as to height. The lowermost roller 7 is journalled either stationarily or may be adapted additionally by a cylinder piston unit to be lifted or lowered in a manner known per se. However, the suspension spindle may have its uppermost end connected to the calender frame while only the lowermost roller 7 is adjustable as to height. In the illustrated embodiment, the suspension spindle is connected to the bearing 8 of the uppermost roller 1.

The rollers which are arranged below the rollers 1 are designated with the reference numerals 2–7. Each of the rollers located below the uppermost roller 1 has its ends journalled in roller bearings 9–13.

The two bearings 8 which support the ends of the roller 1 have a bore 14 through which extends the upper section 15 of the suspension spindle generally designated 16 which spindle above the bearing 8 has a shoulder 17. When the bearing 8 is lowered, the suspension spindle 16 follows this movement and inversely when the bearing 8 is lifted, the suspension spindle 16 is likewise lifted.

With the embodiment according to FIG. 1, the suspension spindle is formed of each of the screw elements 18 to 22 respectively associated with the intermediate rollers 2–6. The section 15 which extends through the bore 14 of the bearing 8 of the uppermost roller 1 is provided with a bushing 23 the upper end of which forms a shoulder 24 and which is provided with an inner thread 25.

Figure 2:
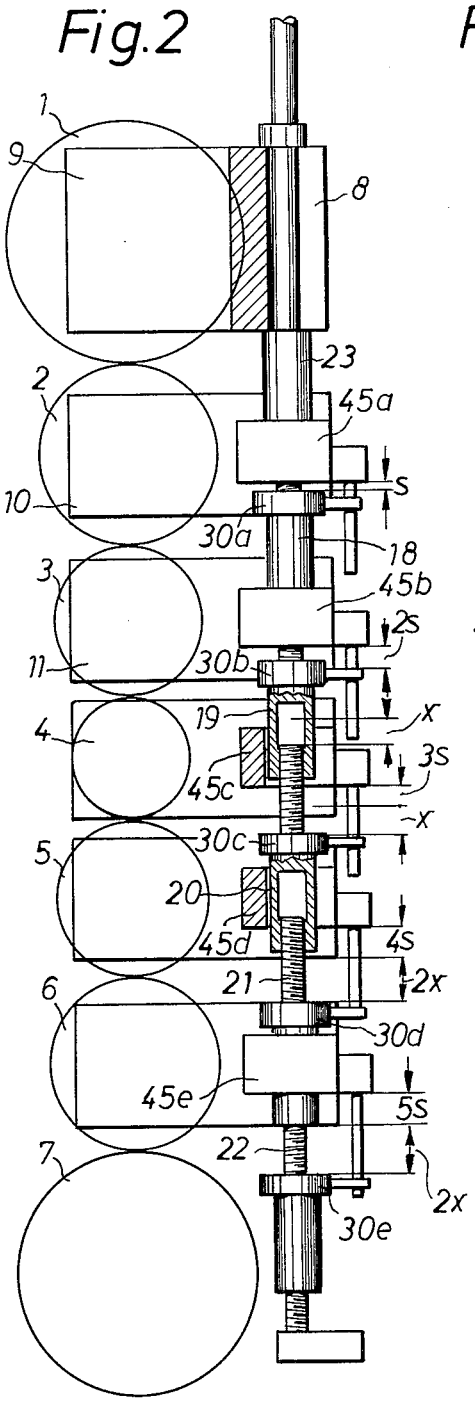
FIG. 2 shows the diagrammatic section through a device of FIG. 1 but with an exchanged smaller roller while the rollers rest upon each other but the distance between the supporting members has not been corrected yet.
Figure 3:
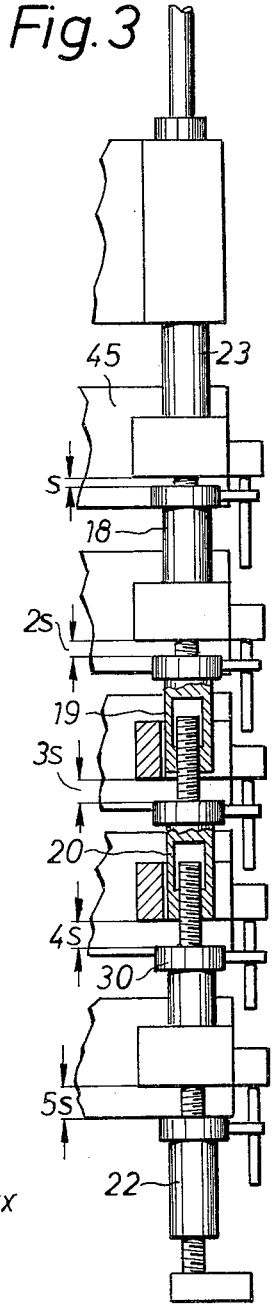
FIG. 3 illustrates the position of the parts after the supporting members have been adjusted.
Figure 4:
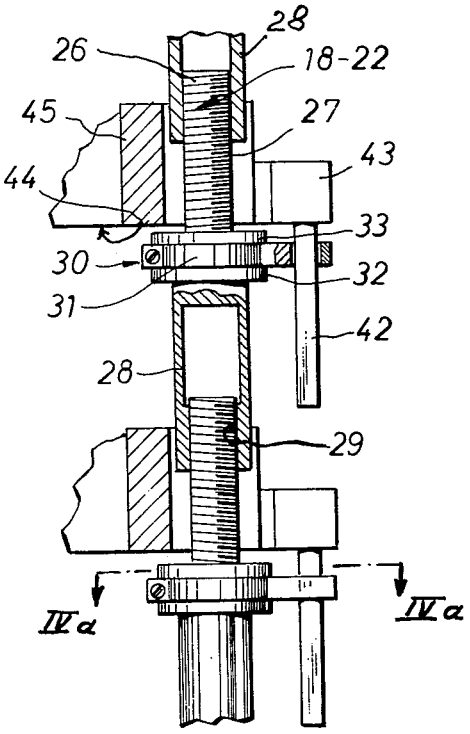

When the screw elements are designed in conformity with FIGS. 1 and 4, each screw element comprises a screw bolt 27 and a sleeve 28 with an inner thread 29 (FIG. 4). The thread 26 of the screw bolt 27 and the inner thread 29 of the sleeves have the same pitch but point in opposite directions. Each threaded bolt 26 of the screw elements 18, 22 engages the thread 29 of the sleeve 28 of the next higher screw element as is shown in FIGS. 1–3, whereas the thread 26 of the uppermost screw element 18 meshes with the thread 25 of the bushing 23 of the section 15.

Between the sleeve 28 with the inner thread 29 and the screw bolt 27 of the screw element 18–22 there is provided an annular member 30 which is either non-rotatably connected to the screw bolt 27 or sleeve 28 or forms one piece therewith.

This annular part has a constriction 31 at both sides of flanges 32, 33 while between the adjacent end faces of these flanges there is provided an annular clamp 34. This clamp 34 has two lateral extensions 36, 37 which form a slot 35. The extensions 36, 37 can be compressed by a screw 38 whereby the clamp 34 can non-rotatably be connected to the annular part 30. The clamp has a fork-shaped extension 39 with a cutout 41 through which extends a vertical rod 42 in such a way that the clamp 34 with the screw element 18–22 is freely longitudinally displaceable but is prevented from rotation inasmuch as the bar or rod 42 is rigidly connected to an etension 43 of the roller bearing 9–13. Therefore, when the screw 38 is loosened and the clamp 34 is somewhat opened, the annular member 30 can by means of the screw element 18–22 be turned at will, whereas when tightening the screw 38, the screw element is secured against turning.

Each annular member 30 of the screw element 18–22 forms a supporting element while the upper end face of the flange 33 engages the lower edge 44 of a bearing part 45 of the roller bearing 9–13. This bearing part may in a manner known per se consist of a unilaterally open pipe member or the like through which extends threaded spindle or parts thereof in the form of the screw elements 18–22.

It is assumed that the roller 4 is to be replaced by a smaller roller 4' with a diameter that is shorter by the measurement of $2x$. To this end the suspension spindle 16 is pulled by the fact that the two upper roller bearings 8 are moved upwardly so that the parts occupy the position shown in FIG. 1 while the annular parts 30 of the screw elements 18–22 engage the bearing parts 45. In this way, a roller gap $s$ is established between adjacent rollers. After the smaller roller 4' has been inserted and if the rollers have been moved toward each other by lowering the upper roller bearing 8, between the part 30 of the screw element 18 and the bearing part 45 of the roller 2 a gap of the magnitude $s$ is formed while a gap of twice the size forms between the part **30*b* of the screw element 19 and the bearing part 45*b* of the roller 3 (FIG. 2**).

Between the part **30*c* of the screw element 20, which is associated with the roller 4', and the bearing part 45*c* of bearing 11 of this roller, there is obtained a gap of the magnitude $x + 3s$, whereas the annular part 30*d* of the screw element 21 associated with the roller 5 is spaced from the supporting member 45*d* of roller bearing 12 by a distance having the magnitude of $2x + 4s$. The distance between the part 30*e* and the supporting member 45*e*** amounts to $2x + 5s$.

If in the present case due to the reduction in the diameter of the roller 4' in conformity with the present invention only the screw element 20 which is associated with the roller 4 is adjusted by the measurement $x$, on one hand the space above the roller 4' between the roller 4' and the roller 3 is reduced by $x$ to the size $2s$, whereas the intermediate space between the roller 4' and the roller 5 therebelow is reduced by the distance $2x$ to the magnitude of $3s$. It will, therefore, be evident that by the adjustment of a single screw element, the gaps formed on both sides of the exchanged roller are compensated for simultaneously by a single adjusting movement, and in this connection the roller gaps of all rollers therebelow likewise undergo a correction.

Figure 5:
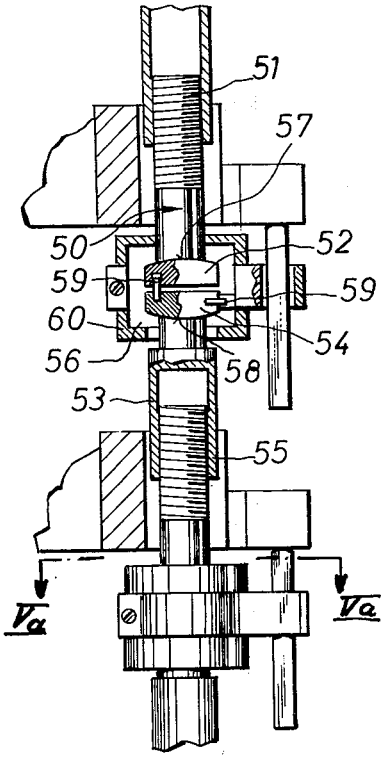
Figure 4A:
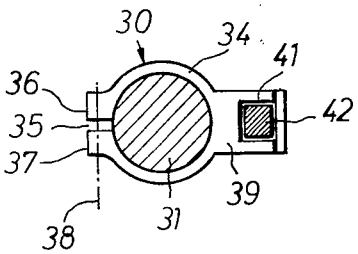
Figure 5A:
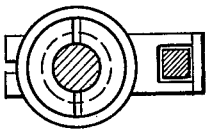

With the embodiment according to FIG. 5, the screw element 50 is formed by an upper threaded bolt section 51 with a lower dish-shaped extension 52, and the lower bushing-like section 53 likewise carries a dish-shaped extension 54. The bushing-like section 53 is provided with an inner thread 55 which extends in a direction counter to the direction of the thread of bolt section 51 but has the same pitch. The two extensions 52, 54 are provided in a coupling housing 56, while the arched end faces 57, 58 of the parts 52, 54 engage correspondingly arched sections of the housing 56. By a corresponding connecting member 59, the extensions 52, 54 are non-rotatably connected to the housing 56 which in its turn is enclosed by a part 60 which corresponds to the part 30 of the embodiment of FIG. 4.

Figure 6:
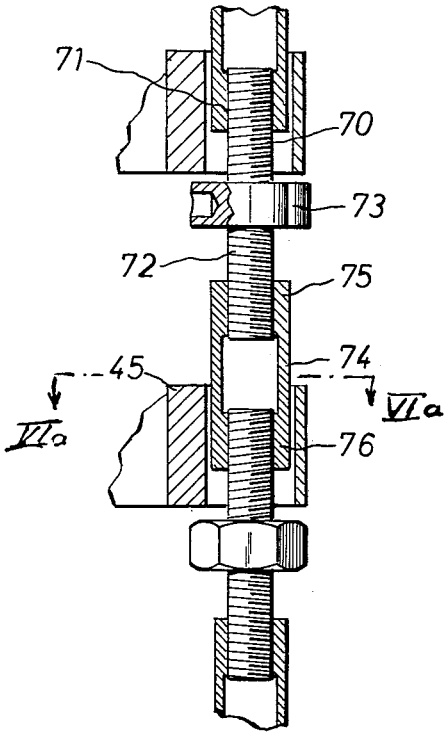

The design of FIG. 6 shows that the screw element 7 may be formed by two threaded bolt sections 71, 72 between which a ring or nut 73 may be non-rotatably mounted.

The lower threaded bolt section 72 of the screw element 70 the thread of which extends in a direction counter to but at the same pitch as the thread of the section 71 extends into a sleeve 74 which is provided with two inner threads 75, 76 respectively oriented in opposite directions.

This sleeve is longitudinally displaceable but by non-illustrated means is non-rotatably connected for instance to the bearing part 45 while being detachably connected thereto. The ring or nut 73 is likewise adapted to be secured against rotation and takes over the task of the parts 30 and 60 according to FIGS. 4 and 5.

Figure 7:
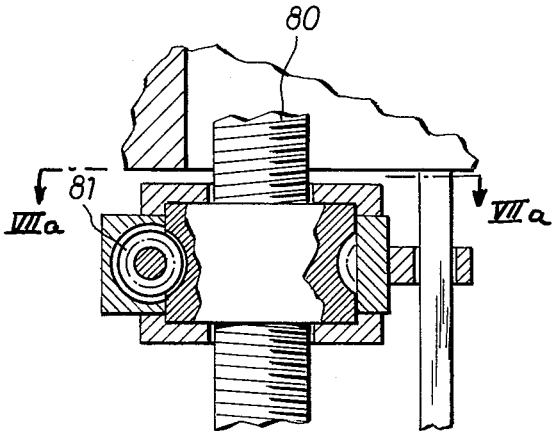
Figure 7A:
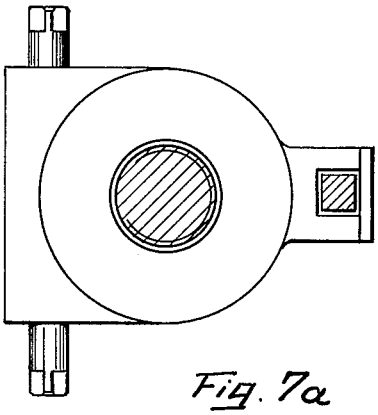
Figure 6A:
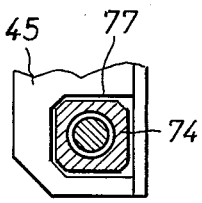

As shown in FIGS. 6 and 6*a*, representing a further design of the invention, sleeve 74 may be provided with a plurality of edges and may extend into a corresponding recess 77 of the bearing part 45. The embodiment of FIGS. 7 and 7*a* shows a possibility of driving the screw element 80 by means of a worm drive 81. Instead thereof, also a spur gear drive may be employed.

It is, of course, to be understood that the present invention is, by no means, limited to the specific showing in the drawing but also comprises any modifications within the scope of the appended claims.

What I claim is:

1. A calender comprising two oppositely located calender sides spaced from each other in horizontal direction, two series of superimposed and vertically adjustable bearing means respectively supported by said calender sides, two series of superimposed calender rollers respectively supported by said bearing means, two suspension spindles respectively associated with said two series of superimposed bearing means and suspended on said calender, each of said suspension spindles comprising a plurality of vertically arranged screw means respectively associated individually with the calender rollers between the uppermost and lowermost calender rollers, each two vertically successive ones of said screw means comprising a sleeve memeber with an inner lefthand thread and a righthand threaded screw bolt, and also comprising a sleeve member with a righthand thread and a lefthand threaded screw bolt meshing with the respective adjacent lefthand threaded sleeve member, each of said screw means including an abutment member interposed between and fixedly connected to the sleeve member and the screw bolt of the respective one and the same screw means, and each sleeve member and the screw bolt threadedly engaging the latter being adjustable at will relative to each other for selectively moving the respective abutment member pertaining thereto toward and away from the respective adjacent bearing means.

2. A calender according to claim 1, in which the thread of two successive screw bolts has the same pitch.

3. A calender according to claim 1, in which said abutment member is adapted to be disengaged temporarily from the screw bolt and sleeve member pertaining thereto.

4. A calender according to claim 1 which includes means respectively associated with said screw means for selectively rotating same.

5. A calender according to claim 1, in which each screw means is composed of two separate element interconnected by a disengageable clutch.

6. A calender according to claim 1, which includes securing means respectively associated with said abutment means and connected to the respective adjacent roller bearing means for preventing said abutment means from accidentally turning.

7. A calender according to claim 1 in which said screw means includes a threaded spindle with two threaded sections respectively directed in opposite directions and having the same pitch and also includes a non-rotatable sleeve with two inner threads of opposite directions and corresponding to said first mentioned thread sections.

* * * * *